US009738423B2

(12) United States Patent
Lamoureux

(10) Patent No.: US 9,738,423 B2
(45) Date of Patent: Aug. 22, 2017

(54) SEALING CAP

(75) Inventor: Richard Lamoureux, Rawdon (CA)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 13/820,088

(22) PCT Filed: Aug. 29, 2011

(86) PCT No.: PCT/EP2011/064818

§ 371 (c)(1),
(2), (4) Date: Apr. 12, 2013

(87) PCT Pub. No.: WO2012/028577

PCT Pub. Date: Mar. 8, 2012

(65) Prior Publication Data

US 2013/0193100 A1 Aug. 1, 2013

Related U.S. Application Data

(60) Provisional application No. 61/378,087, filed on Aug. 30, 2010.

(51) Int. Cl.

| | |
|---|---|
| ***B65D 41/48*** | (2006.01) |
| ***B65D 41/32*** | (2006.01) |
| ***B65D 41/46*** | (2006.01) |
| ***B65D 41/50*** | (2006.01) |
| ***B65D 53/00*** | (2006.01) |
| ***B65D 53/02*** | (2006.01) |

(52) U.S. Cl.

CPC ..... *B65D 41/325* (2013.01); *B65D 41/465* (2013.01); *B65D 41/485* (2013.01); *B65D 41/505* (2013.01); *B65D 53/00* (2013.01); *B65D 53/02* (2013.01)

(58) Field of Classification Search

CPC .... B65D 41/325; B65D 41/465; B65D 53/02; B65D 41/505; B65D 53/00; B65D 41/485

USPC ..... 215/343, 344, 345, 348, 316, 341, 215/DIG. 1; 220/806

See application file for complete search history.

(56) References Cited

U.S. PATENT DOCUMENTS

| | | | | |
|---|---|---|---|---|
| 2,949,205 A * | 8/1960 | Fitz, Jr. | B65D 45/322 215/272 |
| 3,331,523 A * | 7/1967 | Exton | 215/350 |
| 3,973,690 A * | 8/1976 | Schneider | 215/329 |

(Continued)

FOREIGN PATENT DOCUMENTS

| | | |
|---|---|---|
| EP | 0 155 021 A1 | 9/1985 |
| EP | 0 233 722 A2 | 8/1987 |

OTHER PUBLICATIONS

International Search Report of PCT/EP2011/064818, Oct. 18, 2011, 6 pages.

(Continued)

*Primary Examiner* — James N Smalley

(74) *Attorney, Agent, or Firm* — Finnegan, Henderson, Farabow, Garrett & Dunner, L.L.P.

(57) ABSTRACT

The present document describes a cap (110) for closing a container (114), the container having a neck (112) with an upper edge (118) defining a discharge opening (116). The cap comprises a lid (122) and a seal gasket (136) for sealingly engaging the neck of the container. The lid has at least one inwardly extending projection (132) for supporting the seal gasket.

28 Claims, 11 Drawing Sheets

(56) References Cited

U.S. PATENT DOCUMENTS

| | | | | | |
|---|---|---|---|---|---|
| 3,979,002 | A | | 9/1976 | Faulstich | |
| 4,016,996 | A | * | 4/1977 | Aichinger et al. | 215/344 |
| 4,570,811 | A | * | 2/1986 | Lecinski et al. | 215/343 |
| 4,585,135 | A | * | 4/1986 | Sinnott | 215/329 |
| 4,697,716 | A | * | 10/1987 | Mumford B65D | 41/0442 215/341 |
| 4,744,481 | A | * | 5/1988 | Morgan, Jr. | 215/329 |
| 4,877,736 | A | * | 10/1989 | Fliermans | 435/183 |
| 4,938,371 | A | * | 7/1990 | Vercillo | 215/352 |
| 5,222,530 | A | | 6/1993 | Baker et al. | |
| 5,687,865 | A | * | 11/1997 | Adams et al. | 215/253 |
| 6,032,812 | A | * | 3/2000 | Lamoureux | 215/303 |
| 7,637,390 | B2 | * | 12/2009 | Bocola | 220/849 |
| 7,909,188 | B2 | * | 3/2011 | Kim et al. | 215/320 |
| 2002/0195414 | A1 | * | 12/2002 | Kim et al. | 215/254 |
| 2006/0201905 | A1 | * | 9/2006 | Perrin et al. | 215/253 |
| 2007/0023383 | A1 | * | 2/2007 | Perrin B65D | 41/48 215/255 |

OTHER PUBLICATIONS

Written Opinion of the International Searching Authority of PCT/EP2011/064818, Oct. 18, 2011, 3 pages.

* cited by examiner

SEALING CAP

CROSS-REFERENCE TO RELATED APPLICATIONS

This application is a US National Phase of PCT/EP2011/064818 filed on Aug. 29, 2011, which claims the benefit of U.S. Provisional Patent Application Ser. No. 61/378,087 filed on Aug. 30, 2010, which is incorporated herein by reference.

BACKGROUND

This description relates to the field of caps for use in closing and sealing a discharge opening at a container's neck such as that of a liquid container.

Several types of cap are already provided for sealing an opening at a container's neck. The main problem generally encountered is that there is a large variation of dimension of the necks, depending on the method used for making necks (e.g. extrusion blow, extruded blow with compressed neck or injection blow). For reducing number of type of caps and for facilitating cap mounting, manufacturers search to produce the most robust cap as possible. A cap must be able to seal a large variety of neck finishes and design. Also, the cap has to seal the container even if neck's external surface is rough/damaged or the pressure in the container is different than outside. In order to seal properly, the cap has to absorb neck surface defects, dents or scratches due to manufacturing imperfections or handling accidents.

Some molded caps comprise one or more flexible lips made of the same material than the cap with a view to provide a seal. The more lips on a cap the more material is used to manufacture the cap.

Other types of cap comprise a seal gasket located on the inner top of the cap. It is generally a ring-shaped seal which is compressed while the cap is mounted on the neck. For sealing necks having various dimensions, the seal gasket must be voluminous for adapting itself. Usually the seal gasket material is more costly than cap material.

There is therefore a need for improved sealing cap providing a water-tight closure at a lower cost.

BRIEF SUMMARY

It is an object of the present disclosure to provide sealing cap that overcomes or mitigates one or more disadvantages of known cap or at least provides a useful alternative.

To this end, the subject of the invention is a cap for closing a container, as defined in the claims.

This arrangement creates conditions for a cost-efficient solution since it provides for a minimum amount of seal gasket material.

Also, this arrangement can be applied to all kinds of closures, including without limitation, screw cap, threadless cap, crown cork, tamper-evident and tamper-resistant caps, among others.

Additional advantageous features of this cap are specified in the claims.

Thus, according to an embodiment of the invention, there is provided a threadless cap for closing a container, the container having a neck with an upper edge defining a discharge opening; the cap comprising:

a) a lid for overlying and sealingly engaging the upper edge;

b) the lid including:

a disk portion for facing the opening;

a tension ring for retaining the cap on the neck of the container, wherein the tension ring having an inwardly extending rib for engaging the neck of the container; and a shoulder peripherally extending from the disk, wherein the shoulder having at least one inwardly extending projection for supporting a minimum sealing amount of a seal gasket to sealingly engage the neck of the container;

c) a skirt peripherally depending from the lid.

The lid of the cap according to the invention may be made of glass, aluminum, metal, polymer material, polyolefin materials including, but not limited to propylene or ethylene polymers or copolymers, cellulose-based plastics, polystyrene, pvc, nylon, rubber, synthetic rubber, acrylic, polyester, silicone, polyethylene, polypropylene, polyurethane or combinations thereof. Preferably, the lid is formed of a low-density polyethylene (LDPE), however, one should appreciate that other suitable materials can be used including, but not limited to, high-density polyethylene (HDPE) and other olefinic copolymers and mixtures, and flexible vinyl compositions.

The extending projection of the cap according to the invention may be made of a same or different material than the lid. Preferably, the projection is made of a polymer material including, without limitation, cellulose-based plastics, polystyrene, pvc, nylon, rubber, synthetic rubber, acrylic, polyester, silicone, polyethylene, polypropylene, polyurethane. Most preferably, the projection is pliable allowing for a synergetic spring effect with a seal gasket to allow for a better sealing of the container. Preferably, the projection is formed of a low-density polyethylene (LDPE), however, one should appreciate that other suitable materials can be used including, but not limited to, high-density polyethylene (HDPE) and other olefinic copolymers and mixtures, and flexible vinyl compositions The seal gasket of the cap according to the invention is formed of a material that is more pliable than that which forms the lid. Preferably, the seal gasket is formed of a resilient material having more elasticity than that of the lid which allows the seal gasket to more readily conform to the container crown finish and provide a more effective seal than which cap could alone. For example, the seal gasket may be formed of Ethylene vinyl acetate (EVA), elastomers, silicones, or urethanes. Preferably, the liner is formed of a thermoplastic elastomer (TPE). One should appreciate that other suitable materials can be used in accordance with the present invention including, but not limited to, olefin-based thermoplastic elastomers. One should appreciate that the seal gasket may also be formed with foaming agents to form a thermoplastic elastomer foam which may further enhance sealing characteristics of the seal gasket.

Further features and advantages of the present disclosure will become apparent from the following detailed description, taken in combination with the appended drawings, in which:

BRIEF DESCRIPTION OF THE DRAWINGS

It will be noted that throughout the appended drawings, like features are identified by like reference numerals.

DETAILED DESCRIPTION

Figure 1B:
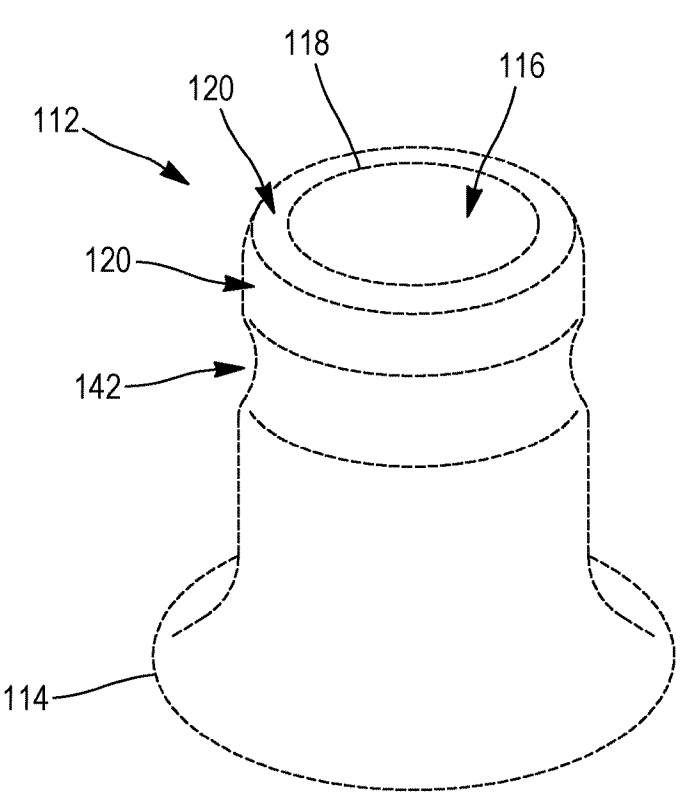
FIG. 1*b* is an axonometric view of the neck of the container shown in FIG. 1*a;*
Figure 1A:
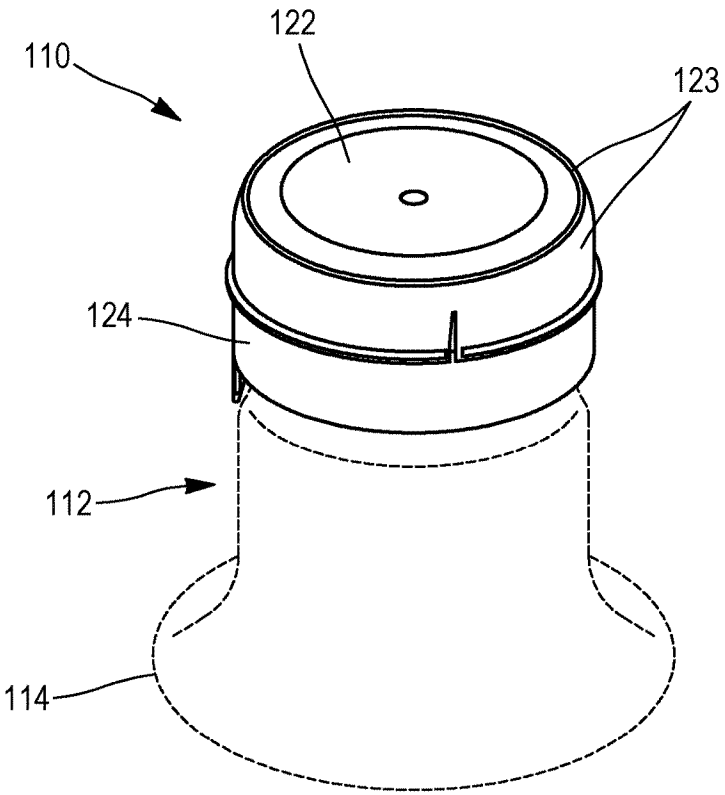
FIG. 1*a* is an axonometric view of a cap for closing a container's neck in accordance with an embodiment.

Referring now to the drawings, and more particularly concurrently to FIG. 1*a* and FIG. 1*b*, there is shown a threadless cap 110 mounted on a neck 112 of a container 114 on FIG. 1*a* and the neck 112 alone on FIG. 1*b*. The neck 112 defines an opening 116 for filling and discharging the container 114. An upper edge 118 surrounds the opening 116. An external surface 120 peripherally extends from the upper edge 118 around the neck 112. The cap 110 comprises a disk 122 for facing the opening 116, a shoulder 123 which peripherally extend from the disk 122 for fitting around the external surface 120 of the neck 112 and a skirt 124 which peripherally extends from the shoulder 123 for fitting around an inflection 142.

Figure 2A:
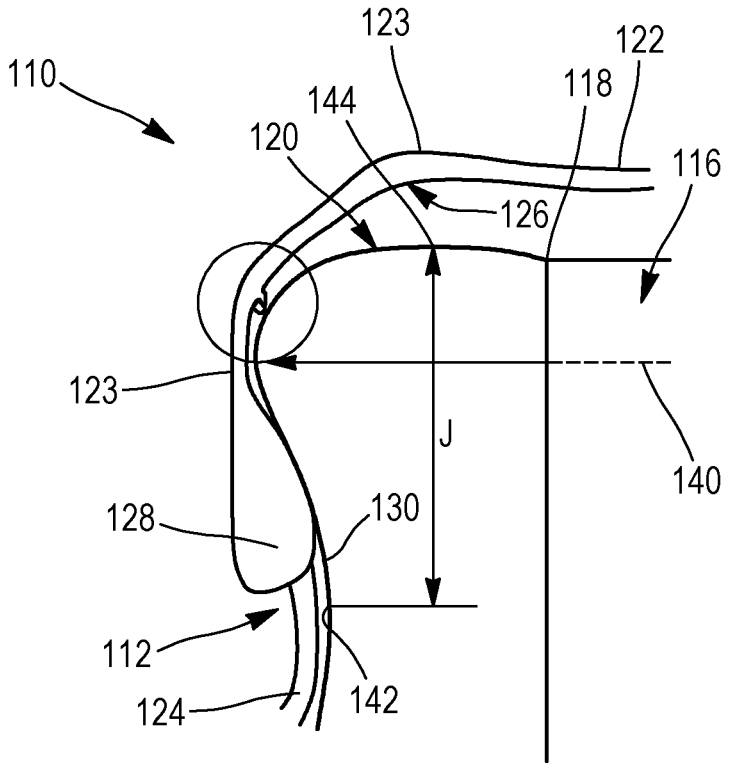
FIG. 2*a* is a schematic partial cross-sectional view of a cap, mounted on a neck, in accordance with the cap of FIG. 1*a;*

Referring to FIG. 2*a*, there is shown a partial cross-sectional view of the cap 110 mounted on the neck 112. The shoulder 123 has an internal surface 126 and a peripheral protrusion 128, namely an engaging means, for engaging the neck 112 in a recess 130 of the neck 112. The protrusion 128 is in a shape of a continuous or non-continuous rib extending along a substantial portion of the perimeter of the shoulder 123. In other embodiments the protrusion 128 can be segmented so that the rib is formed of individual segments disposed along the periphery of the shoulder 123 rather than a continuous structure.

It has been observed that the maximum diameter 140 of neck of water bottles are statistically more precise than the shape of the recess 130 characterized by a distance J between an inflexion 142 of the recess 130 and a top 144 of the neck 112. Many blown finish water bottle manufacturers rework or grind the outside of the bottle at the maximum diameter 140 area to control the size of the maximum diameter, among others. That means that it is easier to laterally seal the cap as shown on FIG. 2*a* rather than to seal the cap on the top 144 without a compensation system.

Figures 2B, 2C:
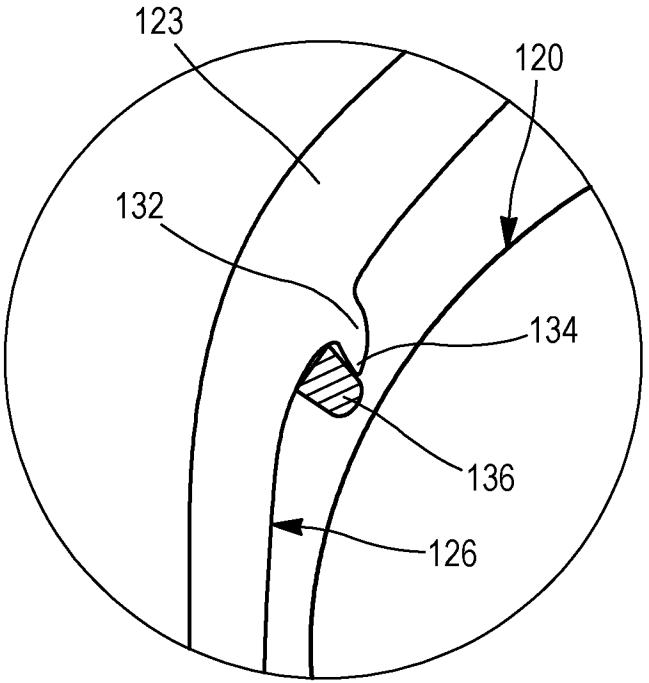
FIG. 2*b* is a schematic expanded partial cross-sectional view of the cap of FIG. 2*a*, being mounted on a neck.
FIG. 2*c* is a schematic expanded partial cross-sectional view of the cap of FIG. 2*a* mounted on the neck.

Referring to FIG. 2*b* and FIG. 2*c*, concurrently referred to, there are respectively shown expansions of the circled area of FIG. 2*a*, the cap 110 being mounted on the neck 112. The shoulder 123 comprises a projection 132 extending from the internal surface 126. The projection 132 has an end portion 134 distal to the internal surface 126. The cap 110 further comprises a seal gasket 136 supported by the end portion 134 of the projection 132. The sealing gasket 136 is non-rigidly supported by the projection 132. More specifically, the sealing gasket 136 is moveable in relation to the projection 132. Starting from the position depicted on FIG. 2*b*, for mounting the cap 110 on the neck 112, the shoulder 123 is downwardly moved to be engaged to the neck 112. The seal gasket 136 contacts the external surface 120. While the projection 132 continues to move downwardly, a portion of the seal gasket 136 rubs more or less on the external surface 120 and gets stuck between the external surface 120 and the end portion 134. In such a manner, the seal gasket 136 is supported by the end portion 134 of the projection 132. On FIG. 2*c*, the seal gasket 136 seals a space existing between the internal surface 126 of the cap 110 and the external surface 120 of the container's neck 112.

The projection 132 is in a form of a continuous projection 132 extending along a substantial portion of the perimeter of the shoulder 123. In other embodiments the projection 132 can be segmented so that the projection 132 is discontinuous and formed of individual segments disposed along the periphery of the shoulder 123 rather than a continuous structure.

Figure 3:
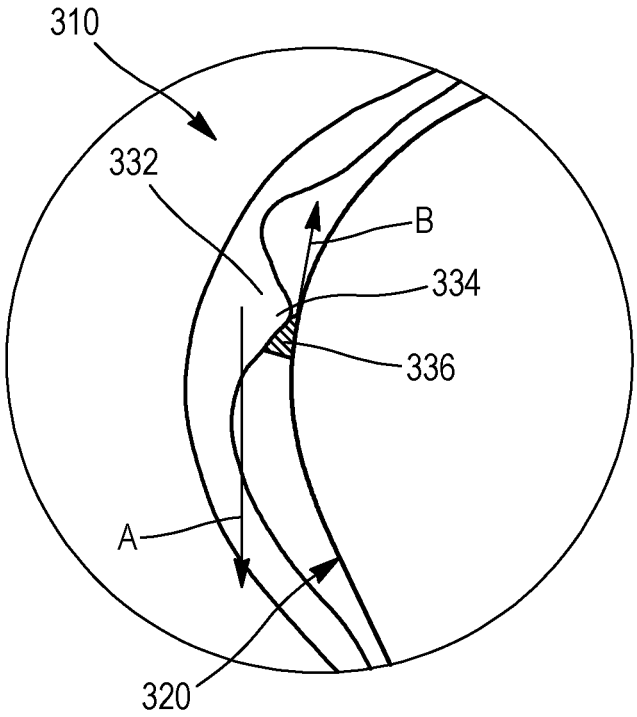
FIG. 3 is a schematic expanded partial cross-sectional view of a cap, mounted on a neck, in accordance with another embodiment.

Referring to FIG. 3, there is shown a detail of a seal gasket 336 supported by an end portion 334 of a projection 332 of a cap 310 according to another embodiment. The lower portion of the projection 332 has a conical form. While the projection 332 is downwardly moved, arrow A (FIG. 3), a frictional force B is applied to the seal gasket 336 by an external surface 320. That compresses the portion of the seal gasket 336 which faces the end portion 334 of the projection 332. The end portion 334 supports the seal gasket 336 against the external surface 320.

Figure 4B:
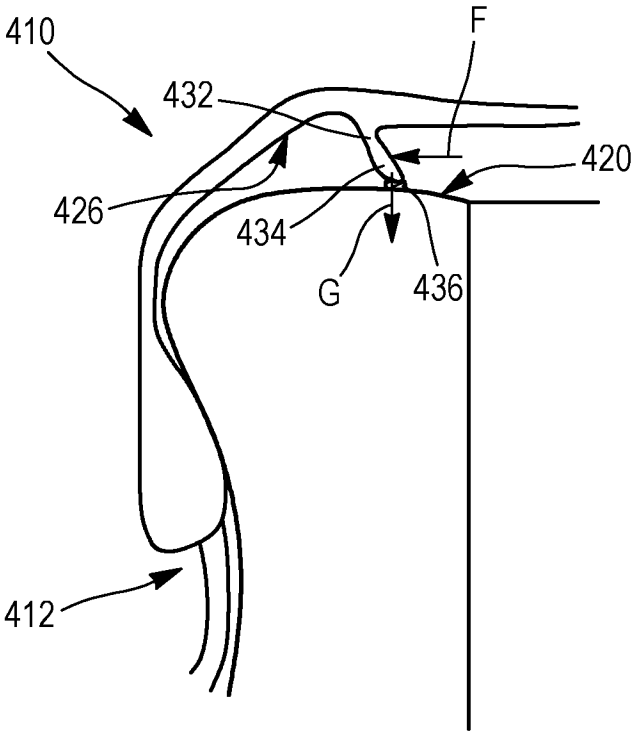
FIGS. 4*a* and 4*b* are schematic partial cross-sectional views of a cap, being mounted on a neck, in accordance with another embodiment.
Figure 4A:
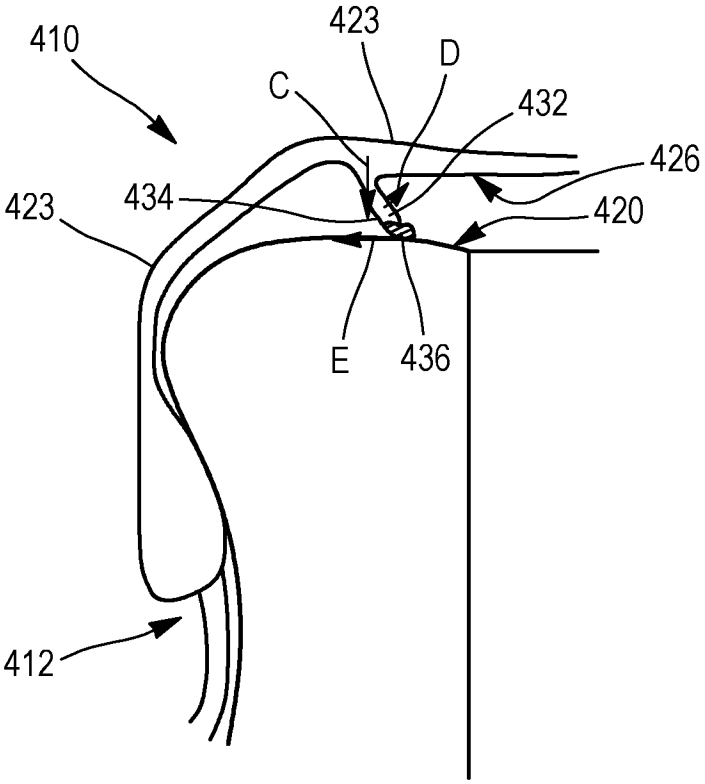

Referring to FIG. 4*a*, there is shown a cap 410 being mounted on a neck 412. A projection 432 is extending from an internal surface 426 of a shoulder 423. The projection 432 is integrally formed with the shoulder 423. A seal gasket 436 is embedded on an end portion 434 of the projection 432. While the shoulder 423 is downwardly moved, arrow C (FIG. 4*a*), the flexible projection 432, namely a lip, is pivoting, arrow D (FIG. 4*a*), so that a frictional force E is applied to the seal gasket 436 by an external surface 420 wedging the seal gasket 436 between the external surface 420 and the end portion 434 of the projection 432. The seal gasket 436 is supported by the end portion 434 of the projection 432.

Referring to FIG. 4*b*, there is shown the cap 410 mounted on the neck 412. The seal gasket 436 is compressed and seals a space between the internal surface 426 of the cap 410 and the external surface 420 of the neck 412. The projection 432 is such oriented that when a pressure F is applied on the projection 432, the end portion 434 presses the seal gasket 436 according to G against the external surface 420 thereby increasing the efficiency of the seal gasket 436. In this manner, the end portion 434 is active and supports the seal gasket 436.

Figure 5:
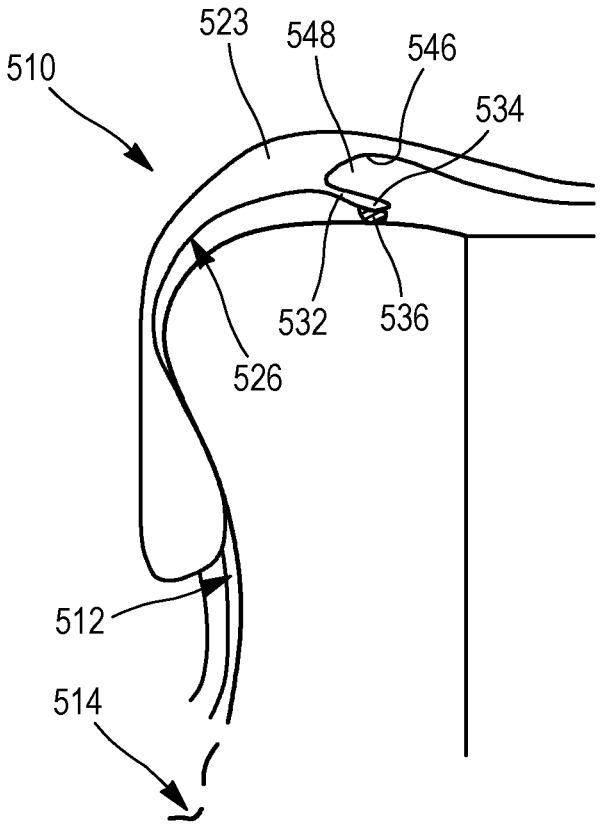
FIG. 5 is a schematic partial cross-sectional view of a cap, mounted on a neck, in accordance with another embodiment.

Referring to FIG. 5, there is shown a cap 510 mounted on a neck 512 of a container 514. A projection 532 is extending from an internal surface 526 of a shoulder 523. A seal gasket 536 is embedded on an end portion 534 of the projection 532. The projection 532 can be flexible for forming a lip allowing compensation of dimension of the neck 512 to ensure the contact of the seal gasket 536 to the neck 512. The internal surface 526 further comprises a peripheral recess 546 forming a groove 548 adjacent to the projection 532. While the container 514 is moved, the fluid contained in the container 514 creates a water hammer effect to the cap. In that case, the groove 548 provides an easier reflux effect of the fluid and reduces the pressure applied to the projection 532. Thereby, the groove 548 improves the sealing in case of a water hammer effect occurring when the container 514 is moved.

Figure 6B:
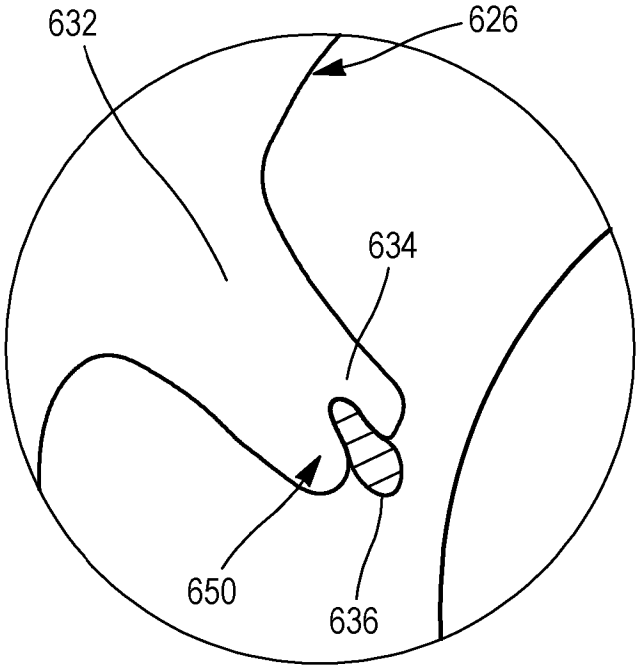
FIGS. 6A and 6B are schematic expanded partial cross-sectional views of a cap, mounted on a neck, in accordance with another embodiment.
Figure 6A:
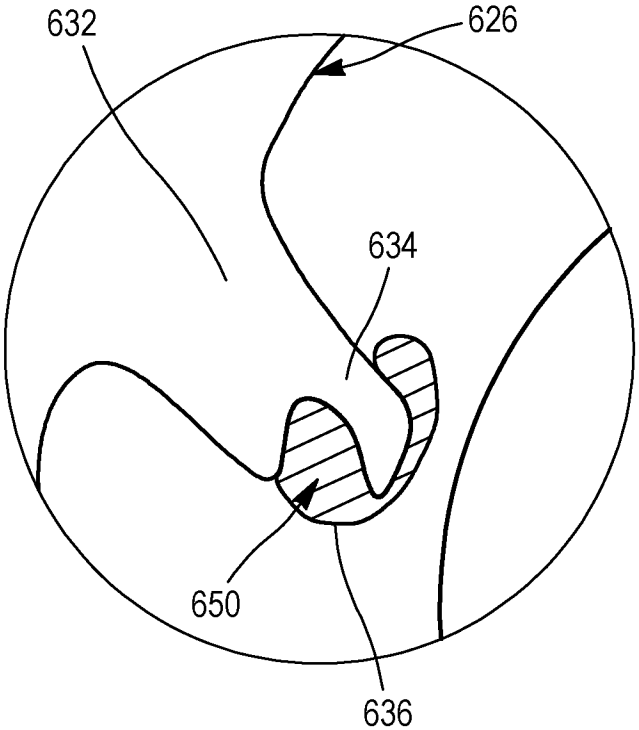

Referring to FIG. 6A, there is shown an expanded view of a projection 632 extending from an internal surface 626 and having an end portion 634. The projection defines a channel 650 in which a seal gasket 636 is located.

Referring to FIG. 6B, there is shown an expanded view of a projection 632 extending from an internal surface 626 and having an end portion 634. The projection defines a channel 650 in which a seal gasket 636 is located.

Figure 7:
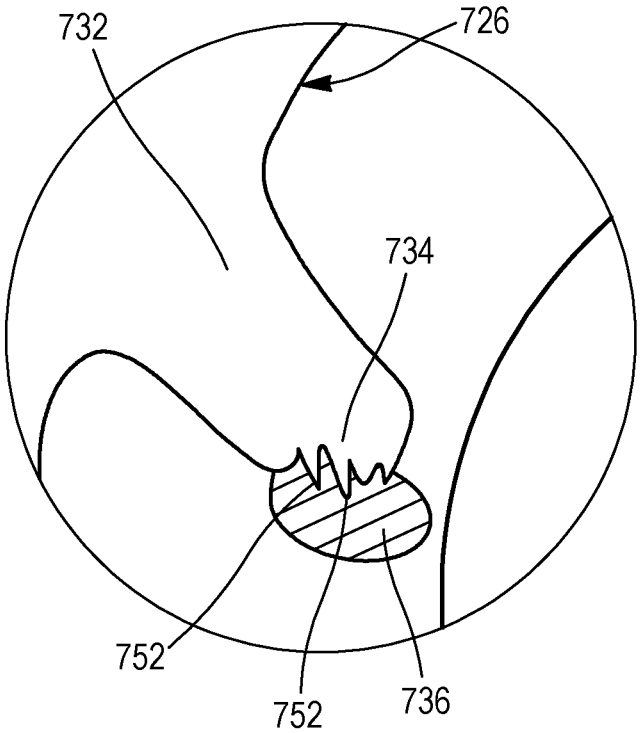
FIG. 7 is a schematic expanded partial cross-sectional view of a cap, mounted on a neck, in accordance with another embodiment.

Referring to FIG. 7, there is shown an expanded view of a projection 732 extending from an internal surface 726 and having an end portion 734. The projection 732 comprises protuberances 752 to aid in retaining a ring-shaped seal gasket 736 supported by the end portion 734.

Figure 8B:
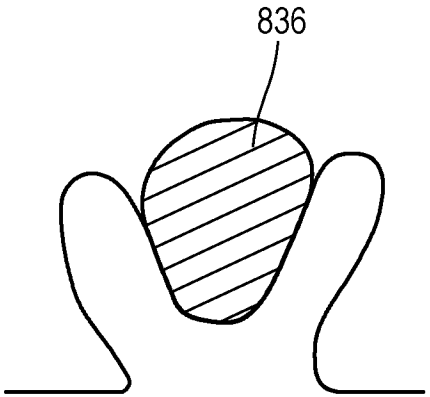
FIGS. 8A and 8B are a schematic cross-sectional views of a cap in accordance with another embodiment.
Figure 8A:
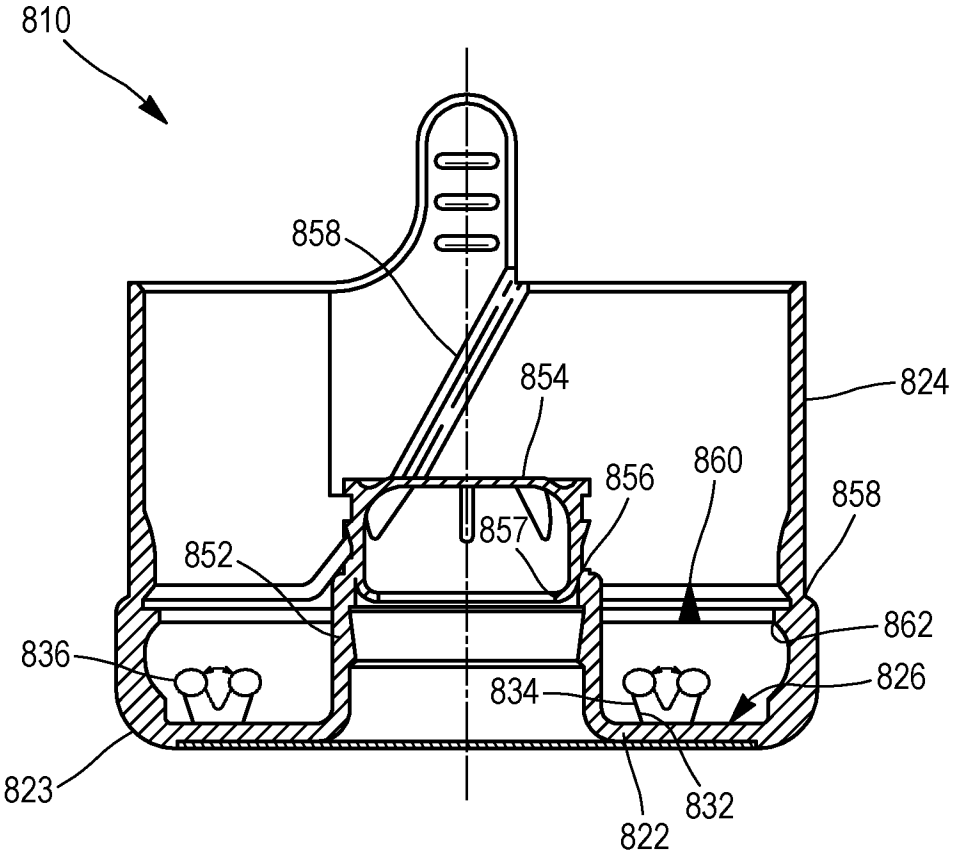

Referring to FIG. 8A, there is shown a cap 810. The cap 810 comprises a disk 822 for facing an opening, not shown, a shoulder 823 which peripherally extend from the disk 822 and having an internal surface 826; and a skirt 824 which peripherally extend from the shoulder 823. A projection 832 extends from the internal surface 826 and has an end portion 834. A seal gasket 836 is supported by the end portion 834 of the projection 832. The cap 810 further comprises an annular sleeve 852 inwardly extending from the disk 822 and sized to receive and guide a feed tube of a liquid dispenser, not shown, used with a container, not shown, closed by the cap 810. The cap 810 further comprises a plug 854 fixed in a detachable manner by means of a frangible connection to a free edge 856 of the annular sleeve 852. The plug 854 is coaxial to the annular sleeve 852 and devised to be separated from the same when the container closed by the cap is inserted into the liquid dispenser. The frangible connection between the annular sleeve 852 and the plug 854 is located in an angularly oriented inlet zone made in the free edge 856 of the annular sleeve 852 for, on one hand, facilitating tearing of the frangible connection during insertion of the cap 810 onto the feed tube of the liquid dispenser and, on the other hand, facilitating engagement of the plug 854 within the annular sleeve 852 during extraction of the feed tube. The plug 854 then acting as an obturator, the plug is also provided with internal gripping means 857, for fixing it temporarily to an upper end of the feed tube during water flow, and with external sealing means for closing the annular sleeve 852 when the container is removed from the liquid dispenser. The plug 854 is then pulled back to the annular sleeve 852 and forced into the same by the feed tube while the same is extracted from the annular sleeve 852. Also, the seal gasket 836 can be positioned inside two projections 832 that can form a "V-Shape" structure, as it is shown in FIG. 8B.

The skirt 824 includes a line of weakness 858 for facilitating a manual tear of the skirt 824 thereby creating a line of tear propagating as a result of a manual pull applied on the skirt. The cap 810 may further include a tear stop 860 at a location intersecting the line of weakness 858. The tear stop 860 prevents the line of tear to propagate beyond the tear stop 860. The line of weakness 858 may include a portion extending across a tension ring 862, namely an engaging means, to reduce a retaining force exerted by the tension ring 862 on the neck of the container when a tear line propagating as a result of a manual pull applied on the skirt 824 extends across the tension ring 862.

Figure 9:
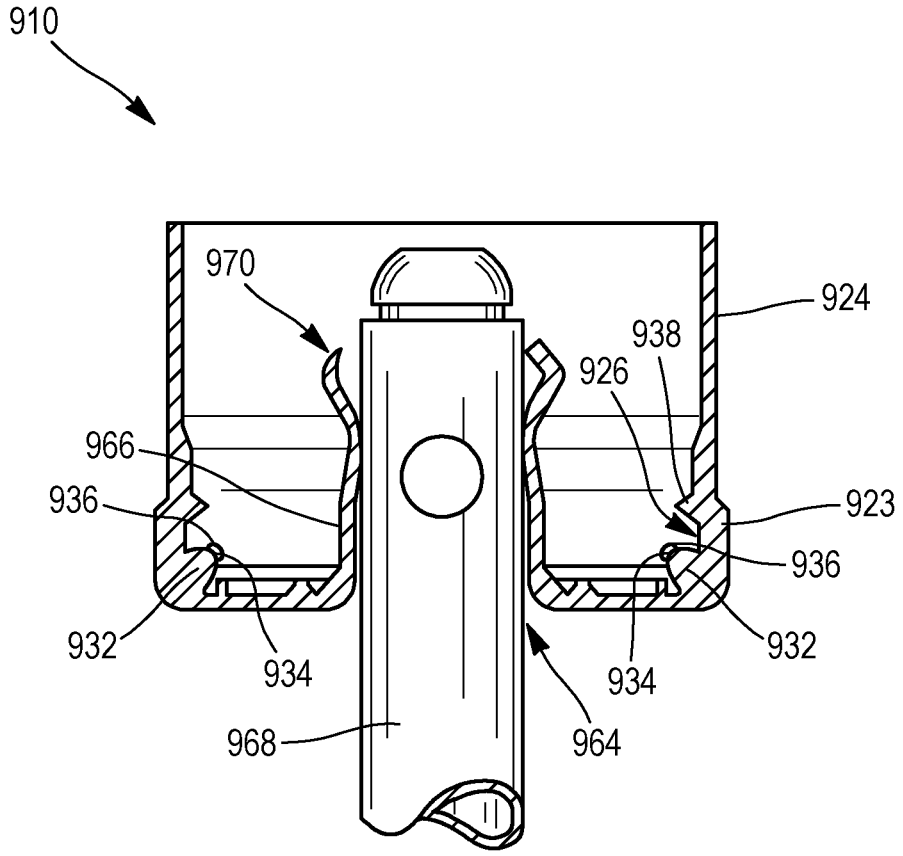
FIG. 9 is a schematic cross-sectional view of a cap in accordance with another embodiment.

In FIG. 9, there is shown a cap 910. The cap 910 comprises a shoulder 923 having an internal surface 926. A projection 932 extends from the internal surface 926 and has an end portion 934. A seal gasket 936 is supported by the end portion 934 of the projection 932. A projection 938 forms a tension ring, namely an engaging means, for engaging the cap on a neck of a container, not shown.

The cap 910 has a central recess 964 including a tubular guiding portion 966 projecting from the cap 910 in a same direction as the skirt 924. The guiding portion 966 is sized and positioned to receive a supply tube 968 of a dispenser. The central recess 964 may also include a bottom portion 970 in the shape of a cone that projects away from the guiding portion 966. The cone is provided with a number of frangible lines extending within meridian planes in such a manner so as to allow splitting of said cone into a corresponding number of petal-shaped segments each having a tip when the container is installed onto the dispenser and its cap 910 and neck are penetrated by the supply tube 968. The cone also having a truncated top and a peripheral surface forming an annular, outwardly projecting step of a generally V-shaped cross-section that is adjacent to the guiding portion and defines an annular inner flange at a distance from the top, whereby, in use, when the cone is split, the flange comes into contact with the supply tube 968 and causes the tips of the segments to extend at a short distance away from the supply tube 968.

Referring to FIGS. 10*a*, 10*b*, 10*c*, 10*d* and 10*e*, there is shown a cross-sectional view of the caps 1010 in which a projection 1032 is having an end portion 1034.

Figure 10C:
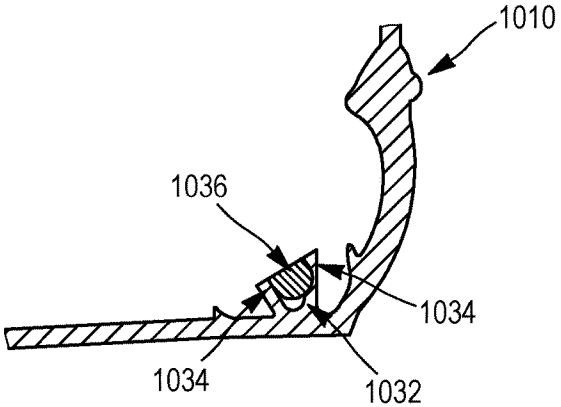
FIG. 10*c* is cross-sectional view of a cap in accordance with another embodiment.
Figure 10B:
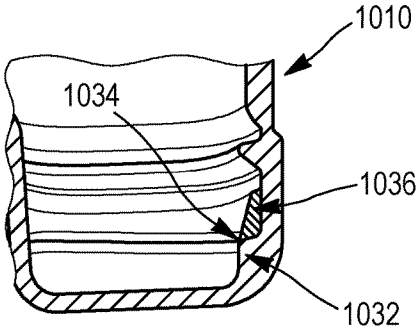
FIG. 10*b* is cross-sectional view of a cap in accordance with another embodiment.
Figure 10A:
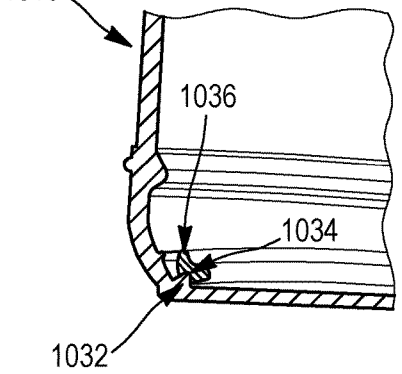
FIG. 10*a* is cross-sectional view of a cap in accordance with another embodiment.

FIG. 10*a* is a cross-sectional view of the cap 1010 in which a first possible projection 1032 is having an end portion 1034.

FIG. 10*b* is a cross-sectional view of the cap 1010 in which a second possible projection 1032 is having an end portion 1034.

FIG. 10*c* shows the seal gasket 1036 being supported by the projections 1032 and 1034 which adopts a "V shape" structure.

Figure 10E:
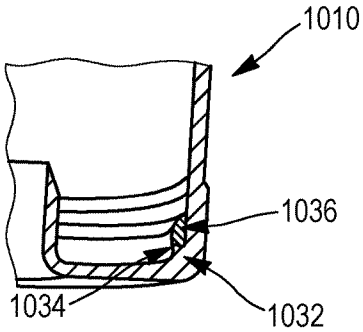
FIG. 10*e* is cross-sectional view of a cap in accordance with another embodiment.
Figure 10D:
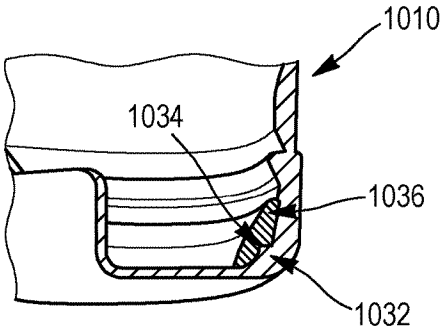
FIG. 10*d* is cross-sectional view of a cap in accordance with another embodiment.

FIG. 10*d* is a cross-sectional view of the cap 1010 in which a third possible projection 1032 is having an end portion 1034.

FIG. 10*e* is a cross-sectional view of the cap 1010 in which a fourth possible projection 1032 is having an end portion 1034. The seal gasket 1036 is supported by the end portion 1034 of the projection 1032.

In any embodiments previously described, the seal gasket can be made of a polymer material being pliable or flexible to allow a watertight contact with any water bottle irrespective of the neck size or variation in necks.

While preferred embodiments have been described above and illustrated in the accompanying drawings, it will be evident to those skilled in the art that modifications may be made therein without departing from the essence of the invention as defined in the appended claims. Such modifications are considered as possible variants comprised in the scope of the disclosure.

The invention claimed is:

1. A cap for closing a container, the container having a neck having an external surface and an internal surface defining a discharge opening, the cap comprising:

a lid for covering the discharge opening and having an internal surface;

at least one inwardly extending projection configured to extend from the internal surface of the lid towards the external surface of the neck of the container, wherein the at least one inwardly extending projection has a distal end portion; and a seal gasket, secured to the cap at only the distal end portion of the at least one inwardly extending projection, for sealingly engaging the external surface of the neck of the container, wherein when the cap is mounted to the neck of the container, the at least one inwardly extending projection and the seal gasket are configured such that the seal gasket is substantially compressed between the distal end portion and the external surface of the neck of the container, and wherein at least a portion of the seal gasket is configured to move to a position between the distal end portion and the neck of the container when the cap is mounted to the neck of the container.

2. The cap of claim 1, wherein the at least one inwardly extending projection is integral with the lid.

3. The cap of claim 1, wherein the sealing gasket is made of a more compressible material than the at least one inwardly extending projection.

4. The cap of claim 1, wherein the at least one inwardly extending projection is flexible and is configured to pivot when the cap is being mounted to the neck of the container.

5. The cap of claim 1, wherein the at least one inwardly extending projection includes a lip.

6. The cap of claim 1, wherein the seal gasket is ring-shaped.

7. The cap of claim 1, wherein the seal gasket is a bead of resilient material.

8. The cap of claim 1, wherein the at least one inwardly extending projection is continuous.

9. The cap of claim 1, wherein the at least one inwardly extending projection is formed of a plurality of individual segments that are discontinuous.

10. The cap of claim 1, wherein the seal gasket is embedded on the at least one inwardly extending projection.

11. The cap of claim 1, wherein the seal gasket is made from a material different from a material of the lid.

12. The cap of claim 1, wherein the seal gasket includes a polymer material.

13. The cap of claim 1, wherein the at least one inwardly extending projection defines a channel in which the seal gasket is located.

14. The cap of claim 1, wherein the at least one inwardly extending projection comprises one or more protuberances or one or more grooves to aid in retaining the seal gasket.

15. The cap of claim 1, wherein the cap is a threadless cap.

16. The cap of claim 15, wherein the cap further comprises an annular sleeve inwardly extending from a disk of the lid, the cap further comprising a plug fixed in a detachable manner by means of a frangible connection, the plug being coaxial to the annular sleeve, the frangible connection between the annular sleeve and the plug being located in an angularly oriented inlet zone made in the free edge of the annular sleeve.

17. The cap of claim 15, further comprising a central recess including a tubular guiding portion projecting from the lid, the guiding portion sized and positioned to receive a supply tube of a dispenser, the central recess also including a bottom portion in the shape of a cone that projects away from the guiding portion, the cone provided with a number of frangible lines extending within meridian planes, the cone having a truncated top and a peripheral surface forming an annular, outwardly projecting step of a generally V-shaped cross section causes segments of the cone to extend at a short distance away from the supply tube.

18. The cap of claim 15, wherein the lid includes a tension ring for retaining the cap on the neck of the container, wherein the tension ring has an inwardly extending rib for engaging the neck of the container.

19. The cap of any of claim 1, wherein the cap has a skirt peripherally depending from the lid.

20. The cap of claim 18, wherein the lid has a shoulder peripherally extending from the tension ring on an opposite side of a skirt.

21. The cap of claim 20, wherein the at least one inwardly extending projection extends from the shoulder.

22. The cap of claim 19, wherein the lid and the skirt are integrally formed.

23. The cap of claim 19, wherein the skirt includes a line of weakness facilitating a manual tear of the skirt.

24. The cap of claim 23, wherein at least a portion of the line of weakness extends along a tension ring for retaining the cap on the neck of the container.

25. The cap of claim 24, wherein the line of weakness includes a portion extending across the tension ring to reduce a retaining force exerted by the tension ring on the neck of the bottle when the line of tear propagating as a result of a manual pull applied on the skirt extends across the tension ring.

26. The cap of claim 23, further comprising a tear stop at a location intersecting a line of tear propagating as a result of a manual pull applied on the skirt, the tear stop preventing the line of tear to propagate beyond the tear stop.

27. The cap of claim 26, wherein the tear stop includes a thickened portion on the cap.

28. The cap of claim 19, wherein the skirt includes a pull tab.

* * * * *